US011767758B2

(12) United States Patent
Yang et al.

(10) Patent No.: US 11,767,758 B2
(45) Date of Patent: Sep. 26, 2023

(54) FLUID CIRCULATION SYSTEM AND METHOD FOR OPERATING SAME, COMPUTER-READABLE MEDIUM, AND CONTROLLER

(71) Applicant: Emerson Climate Technologies (Suzhou) Co., Ltd., Jiangsu (CN)

(72) Inventors: Donghui Yang, Suzhou (CN); Hongfei Shu, Suzhou (CN)

(73) Assignee: Emerson Climate Technologies (Suzhou) Co., Ltd., Jiangsu (CN)

( * ) Notice: Subject to any disclaimer, the term of this patent is extended or adjusted under 35 U.S.C. 154(b) by 0 days.

(21) Appl. No.: 17/621,153

(22) PCT Filed: Jul. 17, 2020

(86) PCT No.: PCT/CN2020/102854

§ 371 (c)(1),
(2) Date: Dec. 20, 2021

(87) PCT Pub. No.: WO2021/013107

PCT Pub. Date: Jan. 28, 2021

(65) Prior Publication Data

US 2022/0349307 A1 Nov. 3, 2022

(30) Foreign Application Priority Data

Jul. 19, 2019 (CN) ..... 201910654955.1

(51) Int. Cl.
*F01C 1/02* (2006.01)
*F01C 20/06* (2006.01)
*F01C 20/26* (2006.01)

(52) U.S. Cl.
CPC ..... *F01C 1/0215* (2013.01); *F01C 20/06* (2013.01); *F01C 20/26* (2013.01)

(58) Field of Classification Search
CPC ..... F01C 1/0215; F01C 20/06; F01C 20/26; F01C 13/00; F01C 21/00; F01C 2021/165;
(Continued)

(56) References Cited

U.S. PATENT DOCUMENTS 6,135,736 A 10/2000 Tucker, Jr. et al.
2006/0198748 A1 9/2006 Grassbaugh et al.
(Continued)

FOREIGN PATENT DOCUMENTS

CN 1184894 A 6/1998
CN 1186174 A 7/1998
(Continued)

OTHER PUBLICATIONS

Translation—WO-2012042698-A1 (Year: 2023).*
(Continued)

*Primary Examiner* — J. Todd Newton
(74) *Attorney, Agent, or Firm* — Harness, Dickey & Pierce, P.L.C.

(57) ABSTRACT

Provided are a fluid circulation system and a method for operating same, a computer-readable medium, and a controller. The fluid circulation system comprises: a scroll expander, and an external fluid circulation path, which comprises a high-pressure fluid pipe and a low-pressure fluid pipe. The operation method comprises the following steps: before fluid is supplied to the scroll expander, making the fluid pressure in the high-pressure fluid pipe higher than the fluid pressure in the low-pressure fluid pipe by a pre-determined pressure difference; and after the pre-determined pressure difference is realized, starting the scroll expander and supplying fluid to the scroll expander. According to the present disclosure, the technical problem of a scroll expander being unable to be normally started and work can
(Continued)

be avoided, and the invention is simple, practical, convenient, and easily implemented.

13 Claims, 4 Drawing Sheets

(58) Field of Classification Search
CPC ... F01C 2021/1693; F01C 21/04; F01C 21/18
USPC ..... 418/55.1
See application file for complete search history.

(56) References Cited

U.S. PATENT DOCUMENTS

| | | | | |
|---|---|---|---|---|
| 2012/0321497 | A1* | 12/2012 | Takayama | F01C 13/04 418/68 |
| 2014/0216102 | A1 | 8/2014 | Ignatiev et al. | |
| 2017/0002817 | A1 | 1/2017 | Stover | |

FOREIGN PATENT DOCUMENTS

| | | | | |
|---|---|---|---|---|
| CN | 1828022 | A | 9/2006 | |
| CN | 101915239 | A | 12/2010 | |
| CN | 104271891 | A | 1/2015 | |
| CN | 104271899 | A | 1/2015 | |
| CN | 105051370 | A | 11/2015 | |
| CN | 105849371 | A | 8/2016 | |
| CN | 205876712 | U | 1/2017 | |
| CN | 106437856 | A | 2/2017 | |
| CN | 208416615 | U | 1/2019 | |
| JP | 2007170765 | A | 7/2007 | |
| JP | 2009109158 | A | 5/2009 | |
| WO | 2012042698 | A1 | 4/2012 | |
| WO | WO-2012042698 | A1 * | 4/2012 | F25B 1/10 |
| WO | 2014157299 | A1 | 10/2014 | |

OTHER PUBLICATIONS

International Search Report (in English and Chinese) and Written Opinion of the International Searching Authority (Chinese) issued in PCT/CN2020/102854, dated Oct. 23, 2020; ISA/CN.
First Office Action dated Dec. 31, 2021, in corresponding Chinese Application No. 201910654955.1.
Extended European Search Report dated Jul. 17, 2023, in corresponding European Application No. 20844835.7.

* cited by examiner

FLUID CIRCULATION SYSTEM AND METHOD FOR OPERATING SAME, COMPUTER-READABLE MEDIUM, AND CONTROLLER

The present application is the national phase of International Application No. PCT/CN2020/102854 titled "FLUID CIRCULATION SYSTEM AND METHOD FOR OPERATING SAME, COMPUTER-READABLE MEDIUM, AND CONTROLLER" and filed on Jul. 17, 2020, which claims the priority to Chinese Patent Application No. 201910654955.1, titled "FLUID CIRCULATION SYSTEM AND METHOD FOR OPERATING SAME, COMPUTER-READABLE MEDIUM, AND CONTROLLER", filed with the China National Intellectual Property Administration on Jul. 19, 2019, which are both incorporated herein by reference in their entirety.

FIELD

The present disclosure relates to the technical field of fluid circulation system, and in particular to a fluid circulation system including a scroll expander and an operation method thereof, and a computer-readable medium and a controller for executing the operation method.

BACKGROUND

This section provides background information relating to the present disclosure, which may not necessarily constitute the prior art.

Some fluid circulation systems usually include an expander and an external fluid circulation path, wherein the expander is a device that expands a high pressure fluid into a low pressure fluid so as to output mechanical or electrical work. A common expander is a scroll expander. An expansion mechanism of the scroll expander includes an orbiting scroll and a non-orbiting scroll. The orbiting scroll and the non-orbiting scroll are engaged with each other to define a series of expansion cavities between the orbiting scroll wrap and the non-orbiting scroll wrap, and the series of expansion cavities gradually increase in volume radially outward from the center of the expansion mechanism. As a result, a high-pressure fluid entering the expansion mechanism from an intake port at the center of the expansion mechanism becomes a low-pressure fluid after passing through the series of expansion cavities and is discharged out of the expansion mechanism through an exhaust port. In the process of fluid expansion, a driving torque is generated, which may drive a shaft to rotate to output mechanical work or electrical work.

Taking a low-pressure side scroll expander (in which the expansion mechanism is located in a low-pressure zone having exhaust pressure) as an example, usually, a back pressure cavity is provided on a back side of a non-orbiting scroll end plate, and the back pressure cavity is composed of a groove provided on the non-orbiting scroll end plate and a floating sealing ring. The floating sealing ring needs reliable floating to play a sealing role, so as to ensure the normal start-up and normal operation of the scroll expander. However, according to the operation method of the fluid circulation system in the conventional technology, before starting the scroll expander, if the difference between the intake and discharge pressures is too small, the floating sealing ring may not float normally. As a result, a normal pressure difference cannot be established in the scroll expander, and the scroll expander cannot start and work normally, which makes the fluid circulation system unable to operate normally.

Therefore, it is necessary to provide an improved operation method of the fluid circulation system to overcome or alleviate the above technical problems in the conventional technology.

SUMMARY

A general summary of the present disclosure is provided in this section, rather than the full scope of the present disclosure or a comprehensive disclosure of all features of the present disclosure.

An object of the present disclosure is to provide improvement in terms of one or more technical problems mentioned above.

According to one aspect of the present disclosure, an operation method of a fluid circulation system is provided, the fluid circulation system comprising:

a scroll expander; and an external fluid circulation path, which includes a high pressure fluid pipe for supplying fluid to the scroll expander and a low pressure fluid pipe for conveying fluid from the scroll expander, wherein the operation method includes the following steps:

a step of establishing pressure difference: before supplying fluid to the scroll expander, a fluid pressure in the high pressure fluid pipe is made higher than a fluid pressure in the low pressure fluid pipe by a predetermined pressure difference; and a step of starting the scroll expander: after the predetermined pressure difference is reached through the step of establishing the pressure difference, the scroll expander is started and fluid is supplied to the scroll expander.

According to a preferred embodiment of the present disclosure, the predetermined pressure difference is such that the fluid pressure in the high pressure fluid pipe is at least 1.5 times the fluid pressure in the low pressure fluid pipe.

By pre-adjusting the fluid pressure in the high pressure fluid pipe and the fluid pressure in the low pressure fluid pipe to reach the above-mentioned preferred predetermined pressure difference, that is, the fluid pressure in the high pressure fluid pipe is made to be at least 1.5 times the fluid pressure in the low pressure fluid pipe, the possible pressure distribution in the housing of the scroll expander can be predictively adjusted to be within an appropriate range before supplying fluid to the scroll expander, so as to balance the force to which the floating sealing ring is subjected when the scroll expander is started. Therefore, before starting the scroll expander, the problem of unbalanced force of the floating sealing ring can be avoided, and the scroll expander in the fluid circulation system and the fluid circulation system can be fundamentally ensured to start and work normally.

According to a preferred embodiment of the present disclosure, the fluid circulation system further includes a bypass pipe communicated with the high pressure fluid pipe and the low pressure fluid pipe to form a bypass loop, and the step of establishing the pressure difference includes: before supplying fluid to the scroll expander, throttling fluid in the bypass pipe so that a fluid pressure difference is established between the high pressure fluid pipe and the low pressure fluid pipe.

According to a preferred embodiment of the present disclosure, a bypass valve is provided on the bypass pipe, the bypass valve is opened to a predetermined opening degree during the step of establishing the pressure difference, the predetermined opening degree enables the predetermined pressure difference to be reached between the high pressure fluid pipe and the low pressure fluid pipe, and the opening degree of the bypass valve is gradually reduced until being closed during the step of starting the scroll expander.

According to a preferred embodiment of the present disclosure, the fluid circulation system includes a pressurizing part, the pressurizing part has a heat exchanger, so as to be adapted to convert low pressure fluid from the low pressure fluid pipe into high pressure fluid, and conveying the high pressure fluid to the high pressure fluid pipe, and the operation method further includes a preheating step performed by means of the bypass loop, the preheating step is used to preheat the heat exchanger and is performed before the step of establishing the pressure difference.

According to a preferred embodiment of the present disclosure, during the step of establishing the pressure difference, the high pressure fluid pipe is maintained to be fluidly cut off from the scroll expander, and the low pressure fluid pipe is maintained to be in fluid communication with the scroll expander.

According to a preferred embodiment of the present disclosure, the high pressure fluid pipe is provided with a high pressure intake valve for controlling the fluid communication between the high pressure fluid pipe and the scroll expander. The high pressure intake valve remains closed during the step of establishing the pressure difference and is opened when the step of starting the scroll expander is performed.

According to another aspect of the present disclosure, a computer-readable medium is provided, which stores a computer program that, when executed, implements the step of the above operation method.

According to another aspect of the present disclosure, a controller is provided, which includes the computer-readable medium as described above.

According to another aspect of the present disclosure, a fluid circulation system is provided, which includes the controller as described above.

According to a preferred embodiment of the present disclosure, the fluid circulation system includes:

a scroll expander; and an external fluid circulation path, which includes a high pressure fluid pipe for supplying fluid to the scroll expander and a low pressure fluid pipe for conveying fluid from the scroll expander, wherein the fluid circulation system is controlled by the controller such that: before supplying fluid to the scroll expander, a fluid pressure in the high pressure fluid pipe is higher than a fluid pressure in the low pressure fluid pipe by a predetermined pressure difference.

According to a preferred embodiment of the present disclosure, the fluid circulation system includes a bypass pipe communicated with the high pressure fluid pipe and the low pressure fluid pipe to form a bypass loop, and fluid in the bypass pipe is adapted to be throttled to establish a fluid pressure difference between the high pressure fluid pipe and the low pressure fluid pipe.

According to a preferred embodiment of the present disclosure, a bypass valve is provided on the bypass pipe, the bypass valve is adapted to be opened to a predetermined opening degree to reach the predetermined pressure difference and further the opening degree of the bypass valve is adapted to be gradually reduced until being closed.

According to a preferred embodiment of the present disclosure, the scroll expander includes a non-orbiting scroll capable of floating axially, and a back side of the non-orbiting scroll end plate of the non-orbiting scroll is provided with a back pressure cavity sealed by a floating sealing ring.

The high pressure fluid pipe is provided with a high pressure intake valve for controlling a fluid communication between the high pressure fluid pipe and the scroll expander.

To sum up, the fluid circulation system, the operation method thereof, and the computer-readable medium and the controller for executing the operation method according to the present disclosure have at least the following beneficial effects: by adopting the fluid circulation system, the computer-readable medium and the controller according to the present disclosure and implementing the operation method of the fluid circulation system according to the present disclosure, the technical problem that the scroll expander in the fluid circulation system cannot start and work normally is effectively avoided; in addition, the fluid circulation system, the computer-readable medium, the controller and the operation method of the fluid circulation system according to the present disclosure are simple, practical, convenient and easy to implement, have higher cost benefit and greatly improve the working efficiency.

BRIEF DESCRIPTION OF THE DRAWINGS

The foregoing and additional features and advantages of the present disclosure will become more apparent from the following detailed description with reference to the accompanying drawings, which are merely examples and are not necessarily drawn to scale. The same reference numbers are used in the drawings to indicate the same components, and in the drawings.

Figure 1:
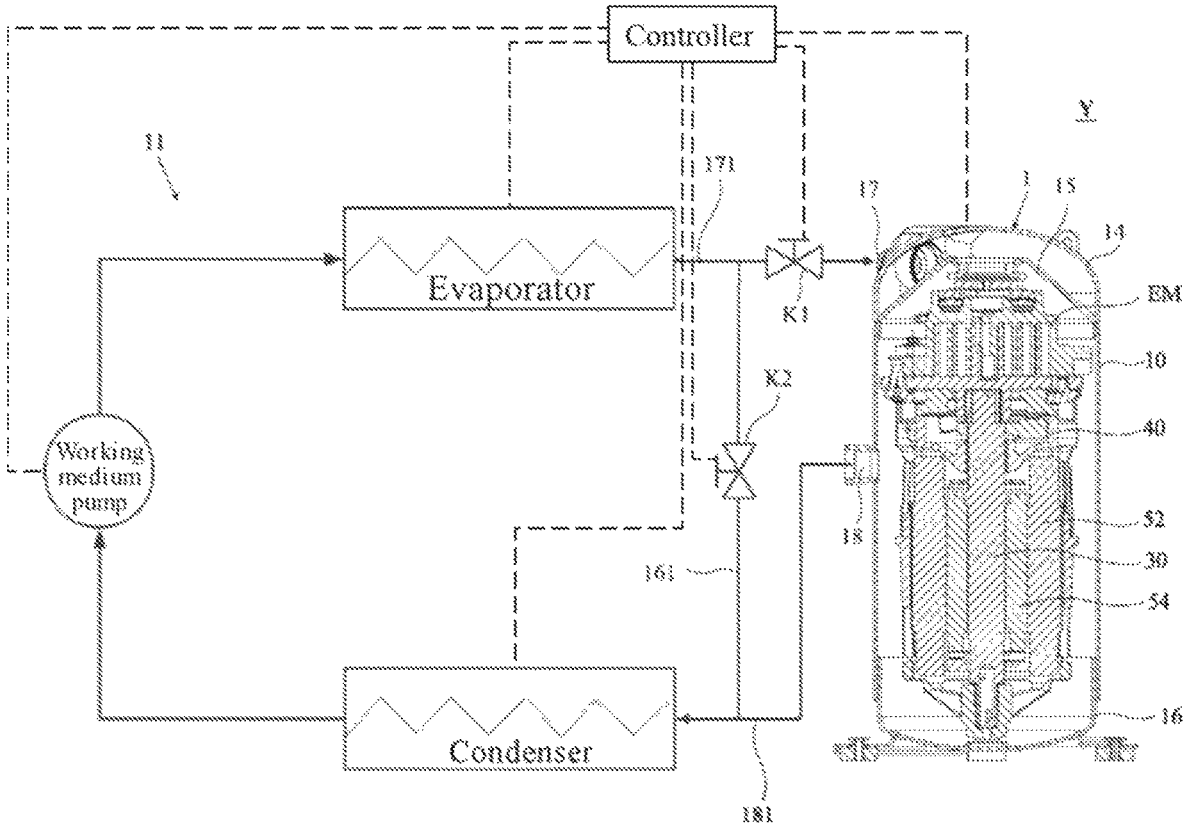
FIG. 1 shows a schematic view of a fluid circulation system.

REFERENCE LIST fluid circulation system Y; scroll expander 1; external fluid circulation path 11;

housing 10; top cover 14; bottom cover 16; partition plate 15; intake pipe 17;

exhaust pipe 18; main bearing housing 40; rotating shaft 30; stator 52; rotor 54;

expansion mechanism EM; non-orbiting scroll 22; orbiting scroll 24;

non-orbiting scroll end plate 220;

high pressure fluid pipe 171; low pressure fluid pipe 181; intake port I;

high pressure intake valve K1; bypass pipe 161; bypass valve K2; back pressure cavity C;

floating sealing ring S; low pressure zone A1; high pressure zone A2.

DETAILED DESCRIPTION OF THE EMBODIMENTS

The preferred embodiments of the present disclosure will now be described in detail with reference to FIGS. 1 to 4.

The following description is merely exemplary in nature and is not intended to limit the present disclosure and the application or use thereof. In each view, corresponding elements or parts use the same reference signs.

In the following exemplary embodiments, the scroll expander is exemplarily shown as a vertical low-pressure side scroll expander. However, the scroll expander according to the present disclosure (hereinafter also referred to as "expander") is not limited to this type, and may be any other suitable types of scroll expander such as a horizontal low-pressure side scroll expander.

In order to facilitate the understanding of the operation method of the fluid circulation system according to the present disclosure, the basic structure and principle of the exemplary fluid circulation system Y will be described below with reference to FIG. 1 and FIG. 2.

As shown in FIG. 1, the fluid circulation system Y (for example, an organic Rankine cycle system utilizing Carnot cycle) includes a scroll expander 1 and an external fluid circulation path 11. The external fluid circulation path 11 includes: a high pressure fluid pipe 171 for supplying fluid to the scroll expander 1, wherein a high pressure intake valve K1 is provided on the high pressure fluid pipe 171; a low pressure fluid pipe 181 for conveying fluid from the scroll expander 1; and a pressurizing part in fluid communication with the high pressure fluid pipe 171 and the low pressure fluid pipe 181, wherein the pressurizing part is configured to pressurize the low pressure fluid from the low pressure fluid pipe 181 into a high pressure fluid, and make it enter the high pressure fluid pipe 171. In an exemplary fluid circulation system Y of the present disclosure, the pressurizing part as shown includes: a condenser (heat exchanger suitable for condensing gaseous low pressure fluid into liquid fluid), a working medium pump (suitable for pumping liquid fluid to an evaporator) and an evaporator (heat exchanger suitable for evaporating liquid fluid into high pressure gaseous fluid). Those of ordinary skill in the art should understand that the application of the fluid circulation system operation method of the present disclosure is not limited to this. In addition, as shown in FIG. 1, the external fluid circulation path 11 further includes a bypass pipe 161 respectively communicates to the high pressure fluid pipe 171 and the low pressure fluid pipe 181, and a bypass valve K2 is provided on the bypass pipe 161.

Generally, before supplying fluid to the scroll expander 1, a preheating step is required to preheat the external fluid circulation path 11, so that the fluid in the external fluid circulation path 11 reaches a certain pressure. Specifically, usually the high pressure intake valve K1 is closed and the bypass valve K2 is opened, so that the high pressure fluid pipe 171, the bypass pipe 161, and the low pressure fluid pipe 181 form a fluid loop. After the pressurizing part (evaporator, condenser and working medium pump, etc.) is started, the fluid circulates along the high pressure fluid pipe 171, the bypass pipe 161 and the low pressure fluid pipe 181 and is continuously pressurized.

Figure 2:
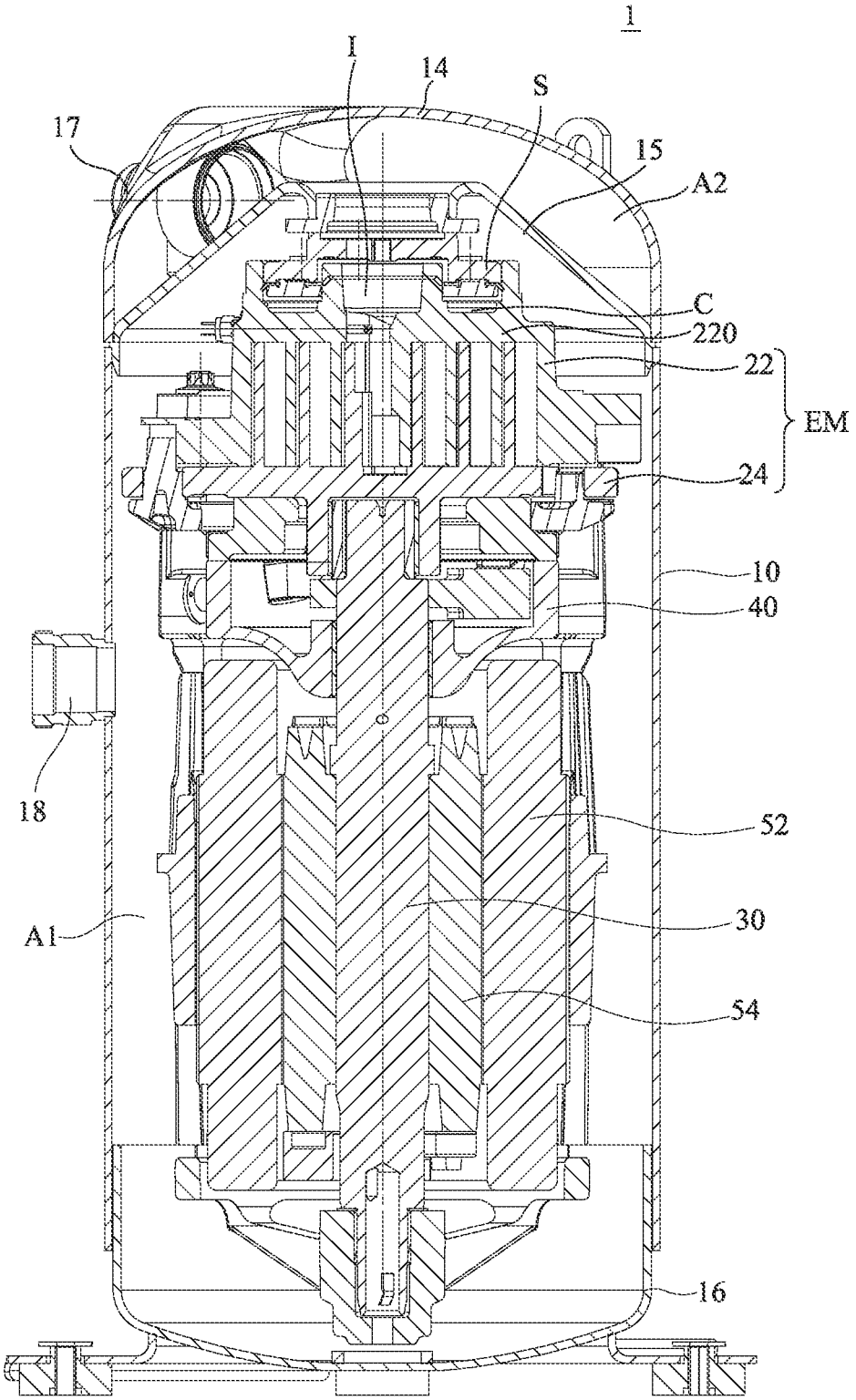
(Prior Art) FIG. 2
FIG. 2 shows a schematic longitudinal section of a scroll expander in the fluid circulation system of FIG. 1.

As shown in FIG. 2, the scroll expander 1 includes a substantially cylindrical housing 10, a top cover 14 provided at one end of the housing 10, and a bottom cover 16 provided at the other end of the housing 10. The housing 10, the top cover 14 and the bottom cover 16 constitute a housing of the scroll expander 1 with a closed space.

The scroll expander 1 further includes a partition plate 15 provided between the top cover 14 and the housing 10 to separate the inner space of the expander into a high-pressure zone A2 (also referred to as high-pressure space) and a low-pressure zone A1 (also referred to as low-pressure space). The high-pressure zone A2 is defined between the partition plate 15 and the top cover 14, and the low-pressure zone A1 is defined between the partition plate 15, the housing 10 and the bottom cover 16. An intake pipe 17 for introducing a high-pressure fluid (also referred to as working fluid) is provided in the high-pressure zone, and an exhaust pipe 18 for discharging the expanded low-pressure fluid is provided in the low-pressure zone A1. The high pressure fluid pipe 171 of the external fluid circulation path 11 communicates with the intake pipe 17 to supply high pressure fluid to the scroll expander 1, and the low pressure fluid pipe 181 communicates with the exhaust pipe 18 to receive the expanded low pressure fluid.

The scroll expander 1 further includes an expansion mechanism EM composed of a non-orbiting scroll 22 and an orbiting scroll 24. The orbiting scroll 24 is capable of revolving relative to the non-orbiting scroll 22 (i.e., the center axis of the orbiting scroll 24 revolves around the center axis of the non-orbiting scroll 22, but the orbiting scroll 24 itself does not rotate around its own central axis).

The non-orbiting scroll 22 includes a non-orbiting scroll end plate 220, a non-orbiting scroll wrap extending from a side surface of the non-orbiting scroll end plate 220, and an intake port I provided at the center of the non-orbiting scroll end plate 220 for allowing high pressure fluid to enter the expansion mechanism EM. The orbiting scroll 24 includes an orbiting scroll end plate and an orbiting scroll wrap extending from a side surface of the orbiting scroll end plate. The following various cavities are defined in the expansion mechanism EM: an exhaust cavity in fluid communication with an exhaust port of the expansion mechanism EM, and an intake cavity in fluid communication with the intake port I, which is formed by the engagement of the non-orbiting scroll wrap and the orbiting scroll wrap, and a series of closed expansion cavities for volumetric expansion of the working fluid. Specifically, in the series of expansion cavities, the radially innermost expansion cavity is adjacent to the intake port I and has substantially the same intake pressure as the introduced high-pressure fluid, so this innermost cavity is referred to as high-pressure cavity, the radially outermost expansion cavity has substantially the same exhaust pressure as the low-pressure fluid to be discharged from the expansion mechanism EM, so this outermost cavity is referred to as low-pressure cavity. The expansion cavity between the high-pressure cavity and the low-pressure cavity has an intermediate pressure lower than the intake pressure and higher than the exhaust pressure, therefore this intermediate cavity is referred to as intermediate pressure cavity. A back pressure cavity C is provided on the other side of the non-orbiting scroll end plate 220, and the back pressure cavity C is sealed by a floating sealing ring S and is in fluid communication with the intermediate pressure cavity.

The high-pressure fluid from the high pressure fluid pipe 171 enters the high-pressure zone A2 in the scroll expander 1 through the intake pipe 17, and enters the expansion mechanism EM through the intake port I. The high-pressure fluid entering the expansion mechanism EM flows through a series of expansion cavities with gradually increasing volumes to be expanded and becomes a low-pressure fluid. The low-pressure fluid is discharged to the low-pressure zone A1 outside the expansion mechanism EM, and then is discharged to the low pressure fluid pipe 181 through the exhaust pipe 18 communicated with the scroll expander 1.

The scroll expander 1 further includes a rotating shaft (may also be referred to as an output shaft) 30. The rotating shaft 30 is rotatably supported by a main bearing provided in the main bearing housing 40. An end of the rotating shaft 30 is coupled to a hub of the orbiting scroll 24 so as to be driven to rotate. When the scroll expander 1 is running, a driving torque is generated during a fluid expansion process performed by the expansion mechanism EM, which drives the rotating shaft 30 to rotate to output mechanical or electrical work.

The scroll expander 1 may further include a generator composed of a stator 52 and a rotor 54. The stator 52 is fixed to the housing 10. The rotor 54 is provided between the stator 52 and the rotating shaft 30. The rotor 54 is fixed to an outer circumferential surface of the rotating shaft 30 to rotate together with the rotating shaft 30 when the scroll expander 1 is operating, thereby enabling the generator to generate electricity.

Figure 3:
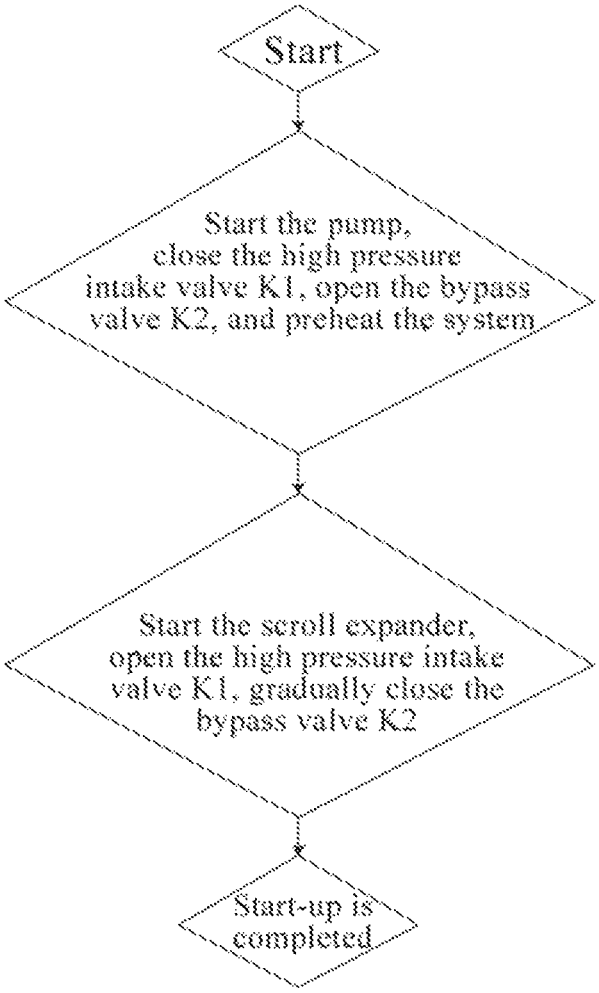
(Prior Art) FIG. 3
FIG. 3 shows a flowchart of an operation method of a fluid circulation system according to the related technology.

According to the operation method of the fluid circulation system in the related art, referring to FIG. 3, it can be seen that the method includes the following steps: 1) carrying out the preheating step as mentioned above (opening the bypass valve and the fluid pump including the working medium pump in the pressurizing part so that the working fluid (working medium) starts to circulate, in the meantime a heat source starts to heat the evaporator and a cold source starts to cool the condenser); and 2) when the fluid in the external fluid circulation path 11 reaches a certain pressure, starting the scroll expander 1, opening the high pressure intake valve K1 to supply fluid to the scroll expander 1, and gradually closing the bypass valve K2.

The floating sealing ring needs reliable floating to play a sealing role, so as to ensure the normal start and normal operation of the scroll expander. However, according to the operation method of the fluid circulation system in the conventional technology, before starting the scroll expander, if the difference between the intake and discharge pressures is too small, the floating sealing ring may not float normally. As a result, the scroll expander can't be sealed normally, so that the normal pressure difference can't be established, and the scroll expander can't start and work normally, which leads to the abnormal operation of the fluid circulation system.

In addition, in an operation method according to another related art in which the high pressure intake valve K1 is not provided or the high pressure intake valve K1 is opened in the preheating step, the steps are roughly as follows: a preheating step; a step of operating the expander in a motor mode (i.e., energizing the expander implemented as an induction asynchronous generator motor to operate); and a step of gradually closing the bypass valve K2 and operating the expander in a generator mode. However, in an operation method according to the another related art, problems similar to the above still exist (in particular, the problem that the floating sealing ring S cannot play a sealing and isolating role, so that the low-pressure zone A1 is directly communicated with the high-pressure zone A2).

In response to the above technical problems, the present disclosure improves the operation method of the fluid circulation system in the related art. Generally speaking, the present disclosure effectively avoids the above problems by establishing a predetermined pressure difference between the high pressure fluid pipe and the low pressure fluid pipe of the external fluid circulation path during the preheating step before supplying fluid to the scroll expander, and realizes the normal start-up and operation of the scroll expander and the fluid circulation system. Specifically, the operation method of the fluid circulation system according to the preferred embodiment of the present disclosure is described in detail below with reference to FIG. 4.

Figure 4:
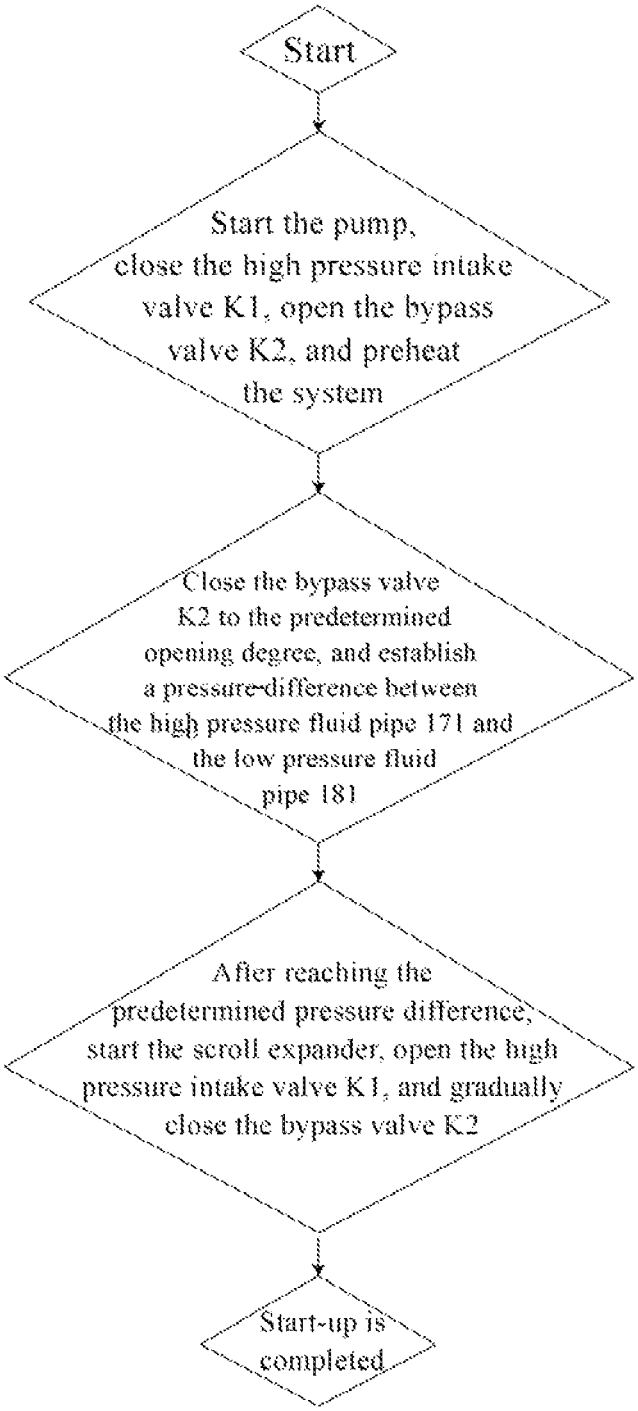
FIG. 4 shows a flowchart of an operation method of a fluid circulation system according to a preferred embodiment of the present disclosure.

FIG. 4 shows a flowchart of an operation method of a fluid circulation system according to a preferred embodiment of the present disclosure. The operation method of the fluid circulation system shown in FIG. 4 includes the following steps: 1) preheating step, wherein the high pressure intake valve K1 is closed and the bypass valve K2 is opened, so that the high pressure fluid pipe 171, the bypass pipe 161, and the low pressure fluid pipe 181 form a fluid loop, and after the pressurizing part (evaporator, condenser and working medium pump, etc.) is started, the fluid circulates along the high pressure fluid pipe 171, the bypass pipe 161 and the low pressure fluid pipe 181 and is continuously pressurized; 2) step of establishing a pressure difference, wherein the bypass valve K2 is turned down to a predetermined opening degree, thereby gradually establishing a pressure difference between the high pressure fluid pipe 171 and the low pressure fluid pipe 181 by throttling, and the pressure difference gradually increases to the desired predetermined pressure difference, wherein the predetermined opening degree may be different according to the value of the predetermined pressure difference expected to be reached; and 3) step of starting the scroll expander 1, wherein, after the predetermined pressure difference is reached, the scroll expander 1 is powered to operate, the high pressure intake valve K1 is opened and the bypass valve K2 is gradually closed until the bypass valve K2 is completely closed, so that the scroll expander 1 starts and works normally; the fluid circulates in the fluid circulation system Y, and then the scroll expander 1 directly outputs mechanical work or the scroll expander 1 is used as a generator to output electrical work based on mechanical work.

To this end, according to a preferred embodiment of the present disclosure, the scroll expander can be reliably started by setting the predetermined pressure difference between the high pressure fluid pipe 171 and the low pressure fluid pipe 181 to be within an appropriate range. Preferably, the predetermined pressure difference is such that the fluid pressure in the high pressure fluid pipe 171 is at least 1.5 times the fluid pressure in the low pressure fluid pipe 181.

Obviously, by adopting the operation method of the fluid circulation system according to the present disclosure as described above, it is ensured that the floating sealing ring floats normally to realize sealing when the scroll expander is started, thereby ensuring the normal start and operation of the scroll expander 1 and the fluid circulation system Y.

Also, it should be noted here that, even if the low pressure fluid pipe 181 is maintained to be cut off from the low pressure zone A1 in the scroll expander 1 during the preheating step (for example, another valve is used), since the low pressure fluid pipe 181 needs to be in fluid communication with the low pressure zone A1 in the scroll expander 1 while supplying fluid to the scroll expander 1, the pressure in the low pressure zone A1 may quickly coincide with the pressure in the low pressure fluid pipe 181, thus ensuring the normal start-up and operation of the scroll expander 1 and the fluid circulation system Y.

Although exemplary embodiments of the operation method of the fluid circulation system according to the present disclosure are described in the foregoing embodiments, the present disclosure is not limited to this. Various modifications, substitutions and combinations can be made without departing from the spirit and scope of protection of the present disclosure. In addition, although the preset pressure difference is established by reducing the opening of the bypass valve in the aforementioned preferred embodiment, it can be understood that the preset pressure difference may also be established by other suitable throttling methods/ devices. In addition, although not specifically described above, it can be understood that, pressure detectors adapted to detect the fluid pressures in the high pressure fluid pipe 171 and the low pressure fluid pipe 181 may be provided, or the fluid pressures in the high pressure fluid pipe 171 and the low pressure fluid pipe 181 may be estimated based on relevant parameters and the obtained fluid pressure data may be transmitted to a controller to control the starting timing of the scroll expander. As a result, the operation method of the fluid circulation system according to the present disclosure may further include a detection step.

In addition, according to the present disclosure, a computer-readable medium, a controller of a fluid circulation system, and a fluid circulation system associated with the above-mentioned fluid circulation system operation method are further provided.

It can be understood that by combining or modifying different embodiments and various technical features and steps in different ways, various different embodiments can be further designed.

The operation method of the fluid circulation system according to the preferred embodiment of the present disclosure is described above in conjunction with the specific embodiments. It can be understood that, the above description is merely exemplary rather than restrictive, and those skilled in the art can conceive various variations and modifications without departing from the scope of the present disclosure with reference to the above description. These variations and modifications shall still fall in the protection scope of the present disclosure.

The invention claimed is:

1. An operation method of a fluid circulation system, the fluid circulation system comprising:

a scroll expander; and an external fluid circulation path, which comprises a high pressure fluid pipe for supplying fluid to the scroll expander and a low pressure fluid pipe for conveying fluid from the scroll expander, wherein the operation method comprises the following steps:

a step of establishing pressure difference: before supplying fluid to the scroll expander, making a fluid pressure in the high pressure fluid pipe higher than a fluid pressure in the low pressure fluid pipe by a predetermined pressure difference; and a step of starting the scroll expander: after the predetermined pressure difference is reached through the step of establishing the pressure difference, starting the scroll expander and supplying fluid to the scroll expander.

2. The operation method according to claim 1, wherein the predetermined pressure difference is such that the fluid pressure in the high pressure fluid pipe is at least 1.5 times the fluid pressure in the low pressure fluid pipe.

3. The operation method according to claim 1, wherein the fluid circulation system further comprises a bypass pipe communicated with the high pressure fluid pipe and the low pressure fluid pipe to form a bypass loop, and the step of establishing the pressure difference comprises: before supplying fluid to the scroll expander, throttling fluid in the bypass pipe so that a fluid pressure difference is established between the high pressure fluid pipe and the low pressure fluid pipe.

4. The operation method according to claim 3, wherein a bypass valve is provided on the bypass pipe, the bypass valve is opened to a predetermined opening degree during the step of establishing the pressure difference, the predetermined opening degree enables the predetermined pressure difference to be reached between the high pressure fluid pipe and the low pressure fluid pipe, and the opening degree of the bypass valve is gradually reduced until being closed during the step of starting the scroll expander.

5. The operation method according to claim 3, wherein the fluid circulation system comprises a pressurizing part, the pressurizing part has a heat exchanger, so as to be adapted to convert low pressure fluid from the low pressure fluid pipe into high pressure fluid, and conveying the high pressure fluid to the high pressure fluid pipe, and the operation method further comprises a preheating step performed by means of the bypass loop, the preheating step is used to preheat the heat exchanger and is performed before the step of establishing the pressure difference.

6. The operation method according to claim 1, wherein during the step of establishing the pressure difference, the high pressure fluid pipe is maintained to be fluidly cut off from the scroll expander, and the low pressure fluid pipe is maintained to be in fluid communication with the scroll expander.

7. The operation method according to claim 1, wherein the high pressure fluid pipe is provided with a high pressure intake valve for controlling the fluid communication between the high pressure fluid pipe and the scroll expander, the high pressure intake valve remains closed during the step of establishing the pressure difference and is opened when the step of starting the scroll expander is performed.

8. A controller of a fluid circulation system, the fluid circulation system comprising:

a scroll expander; and an external fluid circulation path, which comprises a high pressure fluid pipe for supplying fluid to the scroll expander and a low pressure fluid pipe for conveying fluid from the scroll expander, wherein the controller comprises a non-transitory computer-readable medium that stores a computer program that, when executed, implements the following steps of an operation method of the fluid circulation system;

a step of establishing pressure difference: before supplying fluid to the scroll expander, making a fluid pressure in the high pressure fluid pipe higher than a fluid pressure in the low pressure fluid pipe by a predetermined pressure difference; and a step of starting the scroll expander: after the predetermined pressure difference is reached through the step of establishing the pressure difference, starting the scroll expander and supplying fluid to the scroll expander.

9. A fluid circulation system comprising:

a scroll expander; and an external fluid circulation path, which comprises a high pressure fluid pipe for supplying fluid to the scroll expander and a low pressure fluid pipe for conveying fluid from the scroll expander, wherein the fluid circulation system is controlled by the controller such that: before supplying fluid to the scroll expander, a fluid pressure in the high pressure fluid pipe is higher than a fluid pressure in the low pressure fluid pipe by a predetermined pressure difference.

10. The fluid circulation system according to claim 9, wherein the fluid circulation system comprises a bypass pipe communicated with the high pressure fluid pipe and the low pressure fluid pipe to form a bypass loop, and fluid in the bypass pipe is adapted to be throttled to establish a fluid pressure difference between the high pressure fluid pipe and the low pressure fluid pipe.

11. The fluid circulation system according to claim 10, wherein a bypass valve is provided on the bypass pipe, the bypass valve is adapted to be opened to a predetermined opening degree to reach the predetermined pressure difference and further the opening degree of the bypass valve is adapted to be gradually reduced until being closed.

12. The fluid circulation system according to claim 9, wherein the scroll expander comprises a non-orbiting scroll capable of floating axially, and a back side of a non-orbiting scroll end plate of the non-orbiting scroll is provided with a back pressure cavity sealed by a floating sealing ring.

13. The fluid circulation system according to claim 9, wherein the high pressure fluid pipe is provided with a high pressure intake valve for controlling a fluid communication between the high pressure fluid pipe and the scroll expander.

* * * * *